US007258169B2

(12) United States Patent
Fripp et al.

(10) Patent No.: US 7,258,169 B2
(45) Date of Patent: Aug. 21, 2007

(54) METHODS OF HEATING ENERGY STORAGE DEVICES THAT POWER DOWNHOLE TOOLS

(75) Inventors: Michael L. Fripp, Carrollton, TX (US); Bruce H. Storm, Jr., Houston, TX (US); Michael Huh, Corinth, TX (US); Roger Lynn Schultz, Aubrey, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 242 days.

(21) Appl. No.: 10/806,913

(22) Filed: Mar. 23, 2004

(65) Prior Publication Data

US 2005/0211436 A1 Sep. 29, 2005

(51) Int. Cl.
*E21B 4/04* (2006.01)

(52) U.S. Cl. ..... 166/302; 175/104; 166/65.1

(58) Field of Classification Search ..... 166/302, 166/57, 60, 65.1; 175/104; 429/120; 320/128; 428/34.5

See application file for complete search history.

(56) References Cited

U.S. PATENT DOCUMENTS 3,839,091 A 10/1974 Bloomfield et al.
3,876,471 A 4/1975 Jones
3,981,745 A 9/1976 Stedman
4,314,008 A * 2/1982 Blake ..... 429/120
4,416,000 A 11/1983 Scherbatskoy ..... 367/81
4,692,363 A * 9/1987 Reiss et al. ..... 428/34.5
5,202,194 A * 4/1993 VanBerg, Jr. ..... 175/104
5,376,470 A 12/1994 Sprouse
6,098,020 A 8/2000 De Boer
6,253,847 B1 7/2001 Stephenson
6,259,229 B1 * 7/2001 Ashtiani et al. ..... 320/128
6,426,917 B1 7/2002 Tabanou et al.
6,544,691 B1 4/2003 Guidotti
6,575,248 B2 6/2003 Zhang et al.
6,579,638 B2 6/2003 Brassard
6,672,382 B2 1/2004 Schultz et al.
6,684,948 B1 2/2004 Savage
6,705,085 B1 3/2004 Braithwaite et al.
2002/0034668 A1 3/2002 Zhang et al.

FOREIGN PATENT DOCUMENTS

JP 09037412 2/1997

* cited by examiner

*Primary Examiner*—Lanna Mai
*Assistant Examiner*—Matthew J. Smith
(74) *Attorney, Agent, or Firm*—Rodney Carroll

(57) ABSTRACT

An energy storage device for powering a downhole tool may be heated to an effective temperature to improve the operability of the energy storage device. The energy storage device may comprise, for example, a primary battery, a secondary battery, a fuel cell, a capacitor, or combinations thereof. The effective temperature to which the energy storage device is heated may be greater than an ambient temperature in the wellbore near the energy storage device. The energy storage device may be heated using various heat sources such as an ohmic resistive heater, a heat pump, an exothermic reaction, a power generator, a heat transfer medium, the energy storage device itself, a downhole tool, or combinations thereof. A thermal conductor may extend between the heat source and the energy storage device. Further, a thermal insulator may at least partially surround the heat source and the energy storage device.

50 Claims, 10 Drawing Sheets

METHODS OF HEATING ENERGY STORAGE DEVICES THAT POWER DOWNHOLE TOOLS

FIELD OF THE INVENTION

The present invention generally relates to the production of subterranean deposits of natural resources, and more particularly to methods of heating energy storage devices located downhole for powering downhole tools.

BACKGROUND OF THE INVENTION

Subterranean deposits of natural resources such as gas, water, and crude oil are commonly recovered by drilling wellbores to tap subterranean formations or zones containing such deposits. Various tools are employed in drilling and preparing wellbores for the recovery of material therefrom such as logging tools having sensors for measuring various parameters downhole, data storage devices, flow control devices such as valves, transmitters, and receivers. Electrical power is generally required to power such downhole tools. The electrical power may be generated downhole with a power generator such as a turbine generator. However, power generators are relatively complex and often malfunction, resulting in the inability to use downwhole tools powered by such generators until the generators have been repaired or replaced. As such, using energy storage devices such as batteries, fuel cells, or capacitors to power downhole tools is considered a better alternative to the use of power generators.

As illustrated in FIG. 1, the minimum operating temperature of an energy storage device is a function of the rate of discharge of the energy storage device. The capacities of an energy storage device having a relatively low rate of discharge and one having a relatively high rate of discharge are plotted as a function of temperature in FIG. 1. The higher the discharge rate of an energy storage device, the higher the temperatures required for its operation. In particular, it requires higher temperatures to increase the mobility of ions in the electrolyte or the electrodes of the energy storage device. For example, energy storage devices that have solid electrolytes between the anode and the cathode, such as molten salt batteries or solid oxide fuel cells, have relatively high minimum operating temperatures.

Unfortunately, ambient temperatures in the wellbore are often lower than the minimum operating temperatures of energy storage devices utilized therein. As a result, those devices fail to provide downhole tools with sufficient power to operate at full capacity. This problem is commonly encountered when an energy storage device is used at shallow depths in a wellbore where downhole temperatures are lowest. A need therefore exists to develop a method for improving the operability of an energy storage device that has a minimum operating temperature above ambient temperatures in a wellbore in which the device is located.

SUMMARY OF THE INVENTION

Methods of preparing an energy storage device for powering a downhole tool include heating an energy storage device to an effective temperature to improve the operability of the energy storage device. The energy storage device may comprise, for example, a primary battery, a secondary battery, a fuel cell, a capacitor, or combinations thereof. The effective temperature to which the energy storage device is heated is usually greater than an ambient temperature in the wellbore near the energy storage device. The energy storage device may be heated using various heat sources such as an ohmic resistive heater, a heat pump, an exothermic reaction, a power generator, a heat transfer medium, the energy storage device itself, a downhole tool, or combinations thereof. A thermal conductor may extend between the heat source and the energy storage device. Further, a thermal insulator and/or an electrical insulator may at least partially surround the heat source and the energy storage device. In an embodiment, the energy storage device is a fuel cell, and the reactants being fed to the fuel cell are pre-heated via heat exchange with the fuel cell itself.

DETAILED DESCRIPTION OF THE PREFERRED EMBODIMENTS

Figure 1:
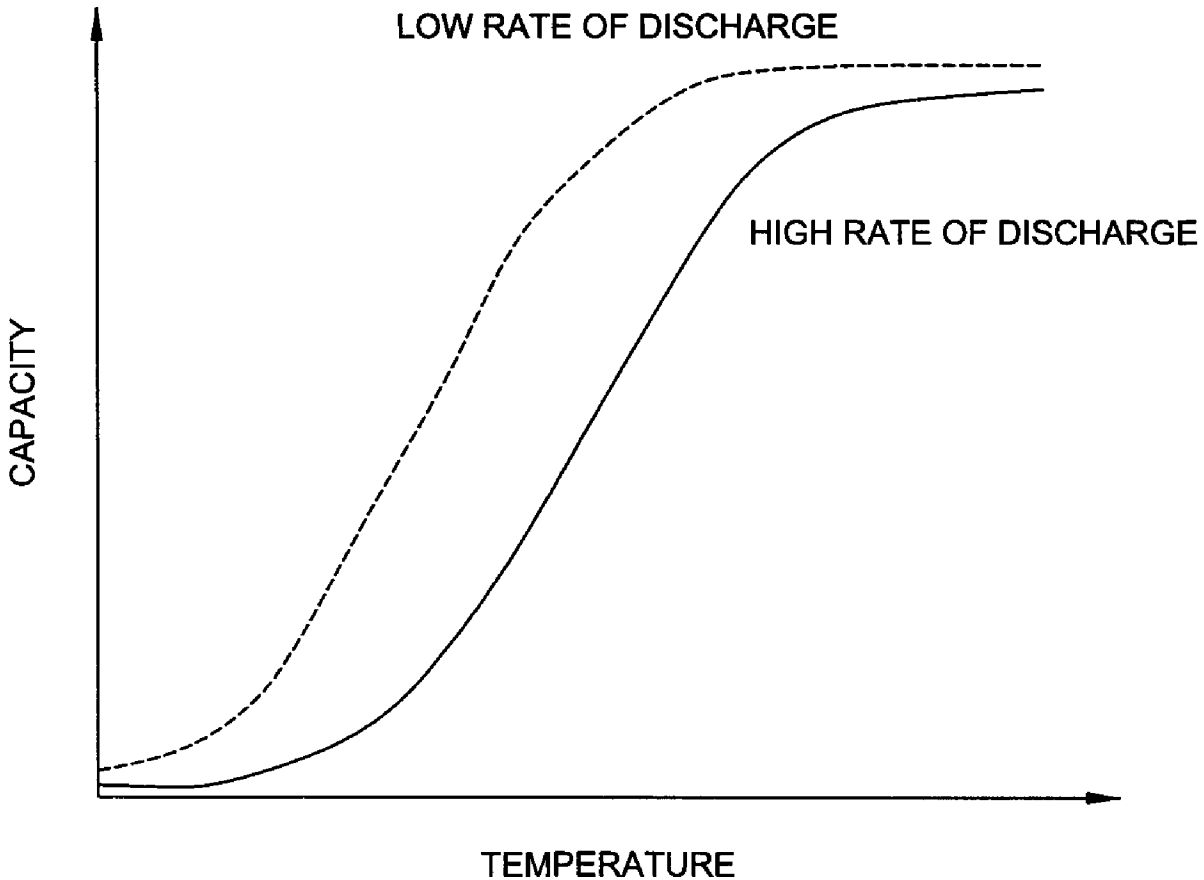
FIG. 1 depicts a plot of the capacity of an energy storage device as a function of its temperature for different rates of discharge.

An energy storage device for powering a downhole tool may be heated to an effective temperature to improve the operability of the device. As used herein, "energy storage device" refers to a device having the ability to store energy that can be used to power a downhole tool, wherein the energy storage device may be located in various locations such as downhole, in an oilfield conduit such as a subsea riser or service tubing/string, or at the surface, and wherein it is not necessarily being used to power a downhole tool while it is being heated. Further, as used herein "downhole tool" refers to a device that can be used to prepare for and engage in the recovery of material from a subterranean formation, wherein the downhole tool is not limited to downhole operation. For example, it may be operated at the surface for testing purposes. Examples of downhole tools that may be operably connected to the energy storage device include a wellbore completion tool, a sensor, a data storage device, a flow control device such as a valve, a transmitter, a receiver, a controller, a testing tool, a logging tool (e.g., measurement while drilling (MWD) tools and magnetic resonance image log (MRIL) tools), or the electronics of another downhole tool. The energy storage device is heated to at least its minimum operating temperature, which can vary depending on the particular type of device being used. It may be heated to even higher temperatures to allow the energy storage device to operate at a higher capacity and/or a higher efficiency. Otherwise, the energy storage device might be inoperable or might not operate as effectively downhole due to, for example, ambient temperatures in the wellbore near the energy storage device being too low.

Any energy storage device suitable for providing power to downhole tools may be employed. Examples of energy storage devices include a primary (i.e., non-rechargeable) battery such as a voltaic cell, a lithium battery, a molten salt battery, or a thermal reserve battery, a secondary (i.e., rechargeable) battery such as a molten salt battery, a solid-state battery, or a lithium-ion battery, a fuel cell such as a solid oxide fuel cell, a phosphoric acid fuel cell, an alkaline fuel cell, a proton exchange membrane fuel cell, or a molten carbonate fuel cell, a capacitor, a heat engine such as a combustion engine, and combinations thereof. The foregoing energy storage devices are well known in the art. Suitable batteries are disclosed in U.S. Pat. Nos. 6,672,382 (describes voltaic cells), 6,253,847, and 6,544,691 (describes thermal batteries and molten salt rechargeable batteries), each of which is incorporated by reference herein in its entirety. Suitable fuel cells for use downhole are disclosed in U.S. Pat. Nos. 5,202,194 and 6,575,248, each of which is incorporated by reference herein in its entirety. Additional disclosure regarding the use of capacitors in wellbores can be found in U.S. Pat. Nos. 6,098,020 and 6,426,917, each of which is incorporated by reference herein in its entirety. Additional disclosure regarding the use of combustion engines in wellbores can be found in U.S. Pat. No. 6,705,085, which is incorporated by reference herein in its entirety.

The energy storage device may have relatively high minimum operating temperatures, which are commonly determined and provided by suppliers and/or manufacturers of energy storage devices. By way of example, the minimum operating temperatures of some high-temperature energy storage devices are as follows: a sodium/sulfur molten salt battery (typically a secondary battery) operates at from about 290° C. to about 390° C.; a sodium/metal chloride (e.g., nickel chloride) molten salt battery (typically a secondary battery) operates at from about 220° C. to about 450° C.; a lithium aluminum/iron disulfide molten salt battery operates near about 500° C.; a calcium/calcium chromate battery operates near about 300° C.; a phosphoric acid fuel cell operates at from about 150° C. to about 250° C.; a molten carbonate fuel cell operates at from about 650° C. to about 800° C.; and a solid oxide fuel cell operates at from about 800° C. to about 1,000° C. By way of comparison, downhole temperatures commonly range from about 100° C. to about 200° C.

Using a high-temperature energy storage device downhole inhibits the device from self discharging while being stored at the ambient temperatures in the wellbore. For example, if a battery is designed to operate at 300° C., then it would experience no self-discharge and no passivation when the battery is stored at 150° C. However, if a battery that normally operates at the ambient downhole temperature is used instead, it would either self-discharge or build a passivation layer, limiting the effectiveness of the battery. The concept of passivation is well known in the art. Therefore, a high-temperature energy storage device that can store electrical energy for extended periods of time may be used to power a downhole tool that requires large amounts of electrical energy.

Various methods may be employed to heat the energy storage device downhole using one or more heat sources or heating means such as an external heat source (see e.g., FIGS. 3 and 4), heat generated by the discharge of the energy storage device itself (see e.g., FIG. 2), or combinations thereof. As used herein, external heat source refers to a source of heat other than the energy storage device itself, and the term "external" does not require that the external heat source and the energy storage device be physically separate. The heat source is coupled to the energy storage device in a heat exchange configuration, for example, positioned proximate the energy storage device and may be physically separate from or integral with (e.g., a housing or integrated heating coil) the energy storage device. An external heat source may be powered by the energy storage device itself. The heat source and the energy storage device are typically at least partially surrounded by a thermal insulator to prevent the heat from being released to the surroundings. Further, the energy storage device and/or the heat source may be at least partially surrounded by an electrical insulator to prevent the energy storage device from short-circuiting. Suitable thermal insulators and electrical insulators are known in the art. Examples of materials that may serve as a thermal insulator include a ceramic solid, ceramic fibers, a glass solid, glass fibers, a polymer solid, polymer fibers, a mineral solid, mineral fibers, a foamed polymer or epoxy, a metalized film, a Dewar flask, a silica aerogel, an air gap, combinations thereof, and nanostructured combinations thereof. Examples of materials that may serve as an electrical insulator include a ceramic solid, ceramic fibers, a glass solid, glass fibers, a polymer solid, polymer fibers, a mineral solid, mineral fibers, a foamed polymer or epoxy, a Dewar flask, a silica aerogel, a dielectric powder such as boron nitride or a titanate compound, combinations thereof, and nanostructured combinations thereof. Both types of insulators are desirably anhydrous and have a relatively high thermal stability. FIGS. 2-9 illustrate various embodiments of methods of heating energy storage devices.

Figure 2:
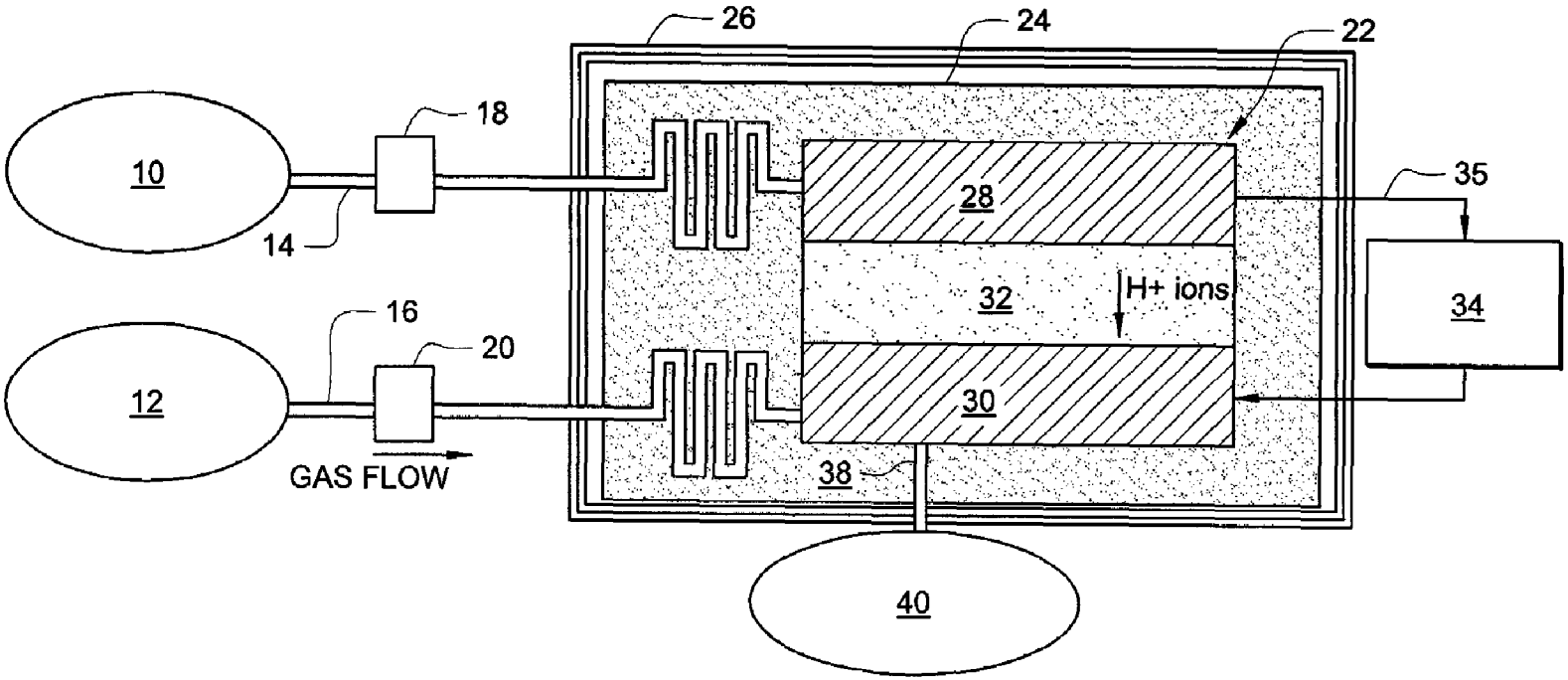
FIG. 2 depicts a process flow diagram of an embodiment in which the reactants being fed to a fuel cell are pre-heated by heat exchange with the fuel cell itself.

Turning to FIG. 2, an embodiment is depicted in which reactants being fed to an acid fuel cell 22 are pre-heated by heat generated by fuel cell 22 itself. That is, fuel cell 22 serves as the heat source in this embodiment. The reactants are typically an anode reactant and a cathode reactant. In an embodiment, the anode reactant is hydrogen ($H_2$), and the cathode reactant is oxygen ($O_2$). However, those skilled in the art would realize that other pairs of anode and cathode reactants may be used. The $H_2$ and the $O_2$ are stored under pressure in anode reactant and cathode reactant storage vessels 10 and 12, respectively. In an embodiment, anode storage vessel 10 contains a metal hydride that provides a high-density means for storing $H_2$. Metal hydride releases $H_2$ via an endothermic reaction, causing the $H_2$ to be cooled. When it is desirable to operate fuel cell 22 to power a downhole tool, the $H_2$ and the $O_2$ may be fed to fuel cell 22 via feed lines 14 and 16, respectively. As the $H_2$ and the $O_2$ flow through feed lines 14 and 16, they pass through respective pressure regulators 18 and 20 such as nozzles to lower their pressures. However, this reduction in the pressures of the reactants also causes their temperatures to drop sharply, usually below ambient temperatures. As a result, the cool reactants may cause the mobility of ions in fuel cell 22 to decrease such that its efficiency decreases. To prevent the temperature of fuel cell 22 from dropping, the reactants are pre-heated by heat exchange with the heat generated by fuel cell 22 before they enter fuel cell 22. In an embodiment, one or both feed lines 14 and 16 are passed across a thermal conductor 24 that extends between fuel cell 22 and the feed lines to increase the temperatures of the reactants therein. A thermal insulator 26 at least partially surrounds fuel cell 22 and a portion of feed lines 14 and 16. Alternate structural heat exchange configurations may be used to pre-heat the feed lines by the heat generated by fuel cell 22.

Optionally, the anode reactant and the cathode reactant may be pre-heated while in their respective storage vessels 10 and 12. For example, storage vessels 10 and 12 may be placed near fuel cell 22 and may comprise a thermally conductive material to provide for the transfer of heat from fuel cell 22 to storage vessels 10 and 12. In this case, thermal conductor 24 may extend all the way to storage vessels 10 and 12, and thermal insulator 26 may at least partially surround vessels 10 and 12 (not shown). Heating the reactants effectively raises their vapor pressures and thereby increases their flow rates from storage vessels 10 and 12. The particular reactants being fed to fuel cell 22 may be selected to ensure that their vapor pressures would not cause storage vessels 10 and 12 to burst when the downhole pressure is at its maximum. At lower downhole temperatures, the heating of storage vessels 10 and 12 may be required to ensure that the reactants have sufficient vapor pressures to be released from the vessels.

The acid fuel cell 22 includes an anode 28, a cathode 30, and an electrolyte 32 comprising an acid such as phosphoric acid for providing an ion transport medium between anode 28 and cathode 30. The $H_2$ feed line 14 is fed to anode 28, and the $O_2$ feed line 16 is fed to cathode 30. Within acid fuel cell 22, a known electrochemical reaction occurs in which positive hydrogen ($H^+$) ions and free electrons are produced at anode 28. The electrons flow as an electrical current through an electrical circuit 35 to an electrical load 34 used to power a downhole tool (not shown). The $H^+$ ions pass through electrolyte 32 and react with the $O_2$ at cathode 30 to produce water as a by-product. The water passes through an exhaust line 38 to a water storage vessel 40, carrying excess heat away from fuel cell 22. The exhaust line 38 may be placed proximate to one or both feed lines 14 and 16 to provide an additional source of heat exchange with the reactants. Moreover, water storage vessel 40 may contain a sorbent material to absorb the exhaust water and thereby generate excess heat to pre-heat the reactants. The water storage vessel and/or sorbent material may be configured for heat exchange with one or both reactant feed lines, for example by running the feed lines through the water storage vessel 40 and/or sorbent material. Any suitable sorbent material known in the art may be used. For example, the sorbent material may be porous materials such as molecular sieves, zeolites, activated aluminas and carbons, calcium oxide (lime), sodium bicarbonate, and combinations thereof. In an alternative embodiment, fuel cell 22 may be an alkaline fuel cell in which oxygen ions pass through electrolyte 32.

Figure 3:
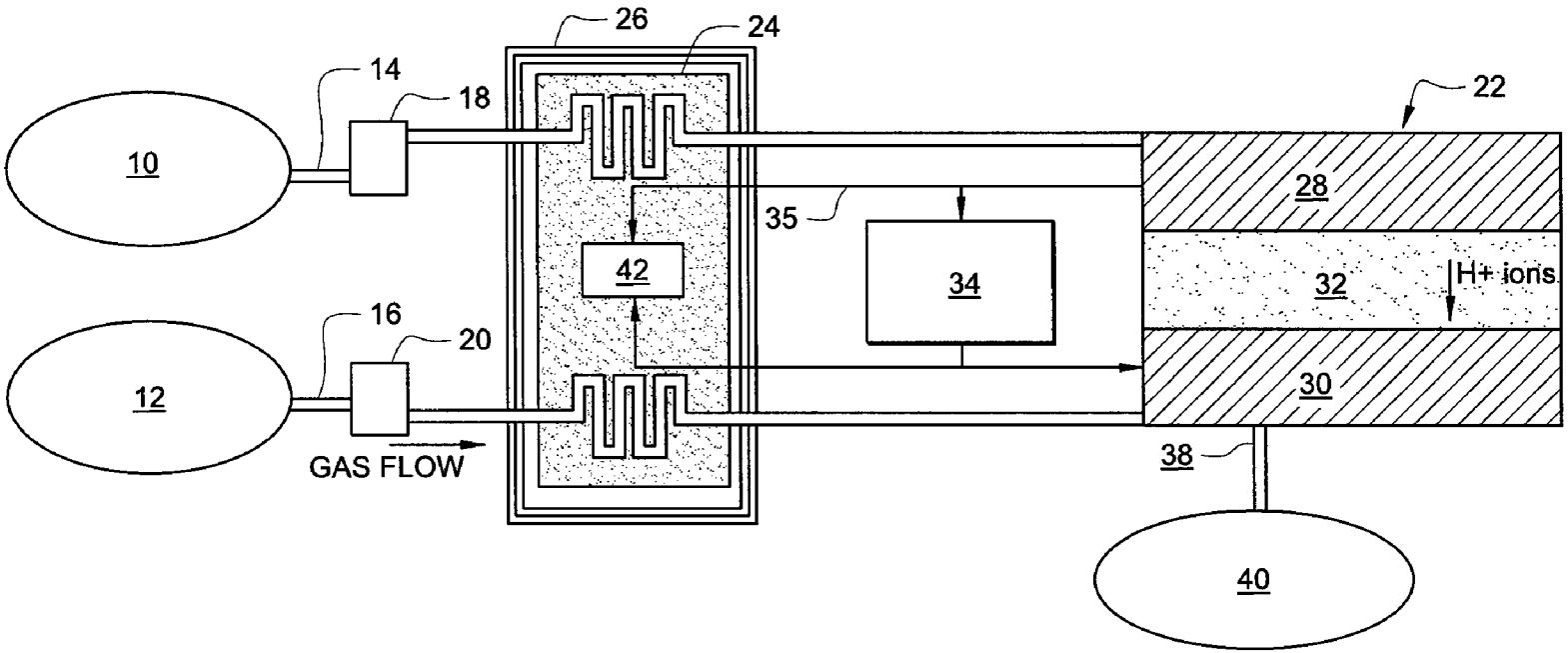
FIG. 3 depicts a process flow diagram of another embodiment in which the reactants being fed to a fuel cell are pre-heated by a resistive heater powered by the fuel cell.
Figure 4:
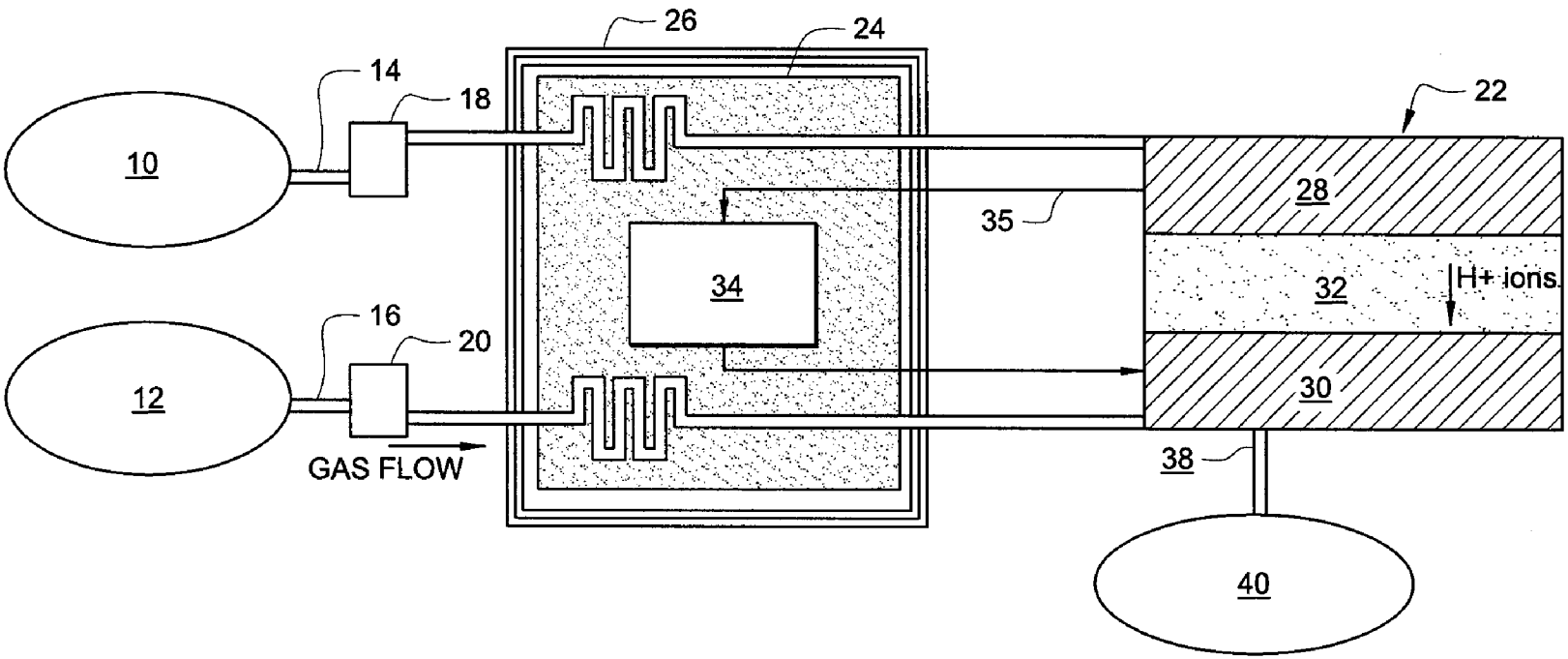
FIG. 4 depicts a process flow diagram of yet another embodiment in which the reactants being fed to a fuel cell are pre-heated by heat generated by an electronic device powered by the fuel cell.

FIGS. 3 and 4 depict additional embodiments similar to the embodiment shown in FIG. 2. However, in these embodiments, one or both feed lines 14 and 16 are heated by an external heat source rather than by fuel cell 22. As shown in FIG. 3, the external heat source may be a heater such as an ohmic resistive heater 42, i.e., a device comprising a resistor through which current may be passed to cause the resistor to increase in temperature. An example of an ohmic resistive heater is heat tape, which may be attached to thermal conductor 24 as shown, to feed lines 14 and 16, to fuel cell 22 or combinations thereof. Thermal conductor 24 extends between resistive heater 42 and feed lines 14 and 16 and thus transfers heat generated by the heater to those feed lines. In the embodiment of FIG. 3, thermal insulator 26 at least partially surrounds resistive heater 42, thermal conductor 24, and the portion of feed lines 14 and 16 being heated by thermal conductor 24. The fuel cell 22 provides an electrical current 35 to electrical load 34 and to power resistive heater 42. Optionally, storage vessels 10 and 12 may also be heated by the external heat source. In this case, thermal conductor 24 may extend further to vessels 10 and 12, and thermal insulator 26 may at least partially surround vessels 10 and 12 (not shown).

In the embodiment shown in FIG. 4, one or both feed lines 14 and 16 are heated by waste heat generated by electrical load 34, which may power a downhole tool such as a transmitter. In this case, thermal conductor 24 extends between electrical load 34 and feed lines 14 and 16. Also, thermal insulator 26 at least partially surrounds electrical load 34, thermal conductor 24, and the portion of feed lines 14 and 16 being heated by electrical load 34. Heat exchange between the relatively cool feed lines and an electrical load such as downhole tool electronics may also provide a benefit in removing heat from and thereby cooling the electronics. It is understood that the external heaters such as resistive heater 42, electronics of a downhole tool such as electrical load 34, or both may also be used to heat energy storage devices other than fuel cells such as batteries and capacitors. Alternate structural heat exchange configurations may be used to pre-heat the feed lines by heat generated by resistive heater 42, electrical load 34, or both.

Figure 5:
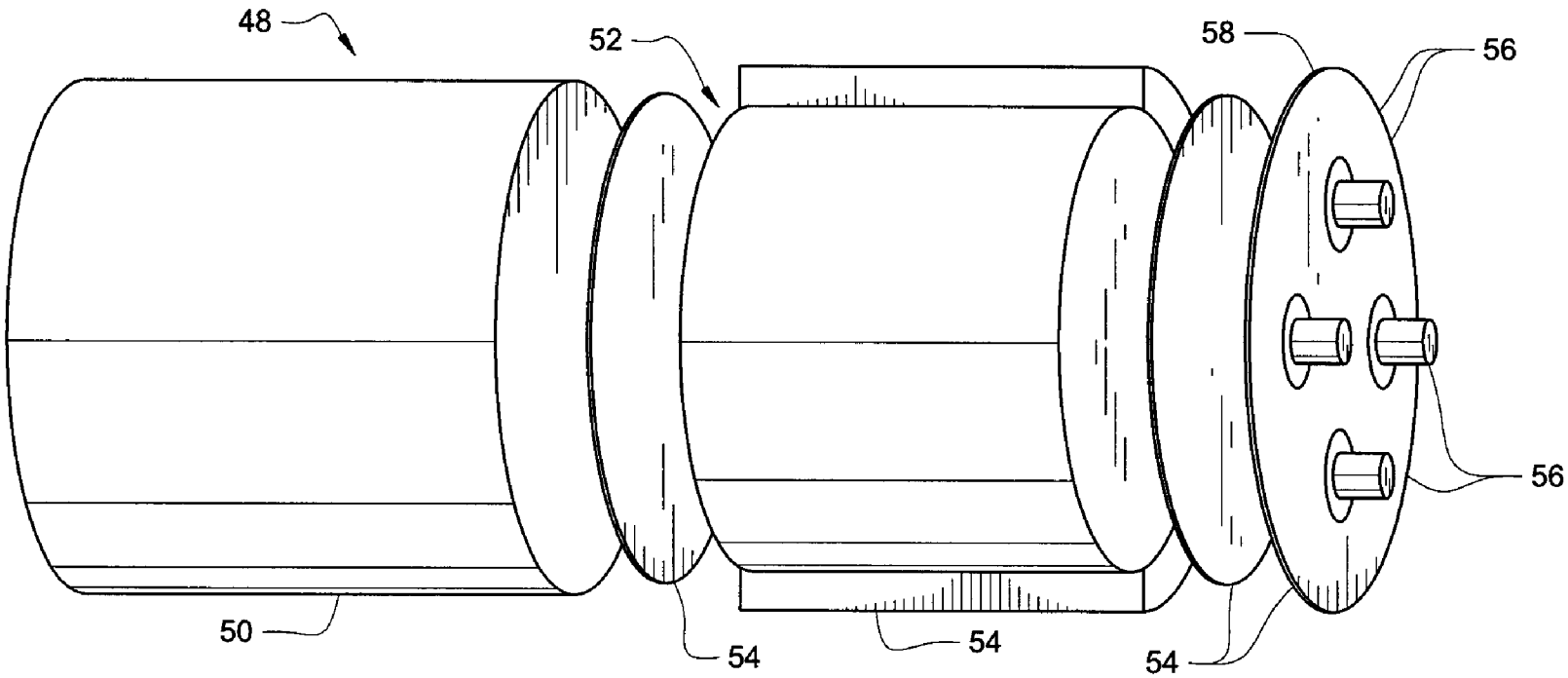
FIG. 5 depicts a perspective view of an embodiment of a battery comprising a plurality of battery cells arranged in a stacked configuration.

FIG. 5 depicts an embodiment of a battery 48 that may be heated downhole. The battery 48 includes an outer container 50 (only a portion of it is shown) for hermetically sealing its contents against outside contaminants such as moisture. The container 50 may be cylindrical in shape and is typically composed of a metal. An electrochemical assembly 52 resides within container 50 and may comprise a heating mechanism and one or more battery cells in a stacked configuration, a spiral wound configuration, a prismatic configuration, or in a concentric configuration. A thermal and electrical insulator 54 at least partially surrounds cell stack assembly 52 for maintaining the temperature of battery 48 and preventing the cell stack from short circuiting with container 50 and a cap 58 disposed at the end of battery 48. Alternatively, the thermal insulator and electrical insulator may be separate materials, and the thermal insulator may be exterior to container 50 and cap 58. Electrical feedthroughs 56 may extend through cap 58 that serves as an output for battery 48 and as an input for a heater within cell stack assembly 52. In one embodiment, an electrical current is supplied to a heat source in cell stack assembly 52 via electrical feedthroughs 56 that initiates an exothermal chemical reaction for heating cell stack assembly 52. In an alternate embodiment, an electrical current is supplied to a heat source in cell stack assembly 52 via electrical feedthroughs 56 that powers a resistive heater for heating cell stack assembly 52.

Figure 6:
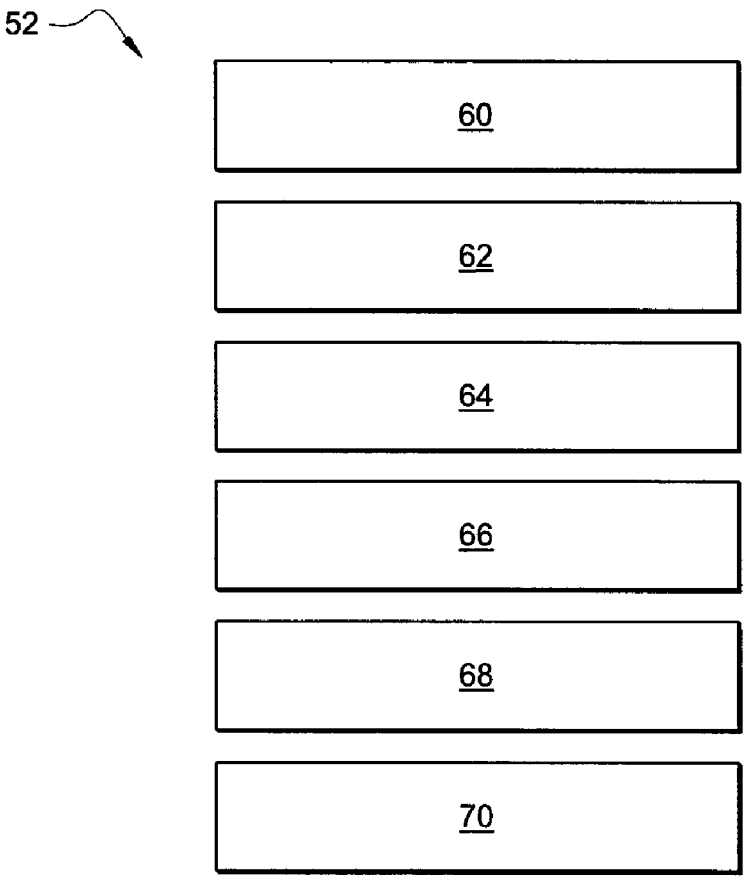
FIG. 6 depicts a detailed view of a single battery cell in the embodiment shown in FIG. 5.

FIG. 6 illustrates an embodiment of a single cell of the cell stack assembly 52 shown in FIG. 5, which may include multiple cells connected in an electrical parallel configuration. Alternatively, the cells could be connected in an electrical series configuration (not shown). The single cell may include a heat source 60 such as an ohmic resistive heater or a heater for performing an exothermic chemical reaction. The exothermic chemical reaction desirably minimizes the amount of gas generated. For example, the exothermic chemical reaction could involve reacting an oxidizer and a fuel in a reaction chamber. Another suitable exothermic chemical reaction is applied in reserve thermal batteries that are used in nuclear missiles. In particular, TEFLON polymer, which is sold by E.I. du Pont de Nemours and Company, is reacted with magnesium, thereby generating over 6,000 calories per cubic centimeter. Yet another suitable exothermic chemical reaction involves reacting zirconium and barium chromate powders that are supported in a fiber mat and have a heat content of about 400 calories per gram (cal/g). Also, a pellet comprising iron powder and potassium perchlorate, which has a heat content in a range of form about 220 cal/g to about 339 cal/g, may be reacted exothermically. The single cell of the cell stack assembly 52 may further include a battery having current collectors 62 and 70 at opposite ends and an electrolyte 66 between two electrode materials 64 and 68 (i.e., the anode and the cathode) in its interior. It is understood that an exothermic chemical reaction may be used to heat other energy storage devices such as capacitors.

Figure 7:
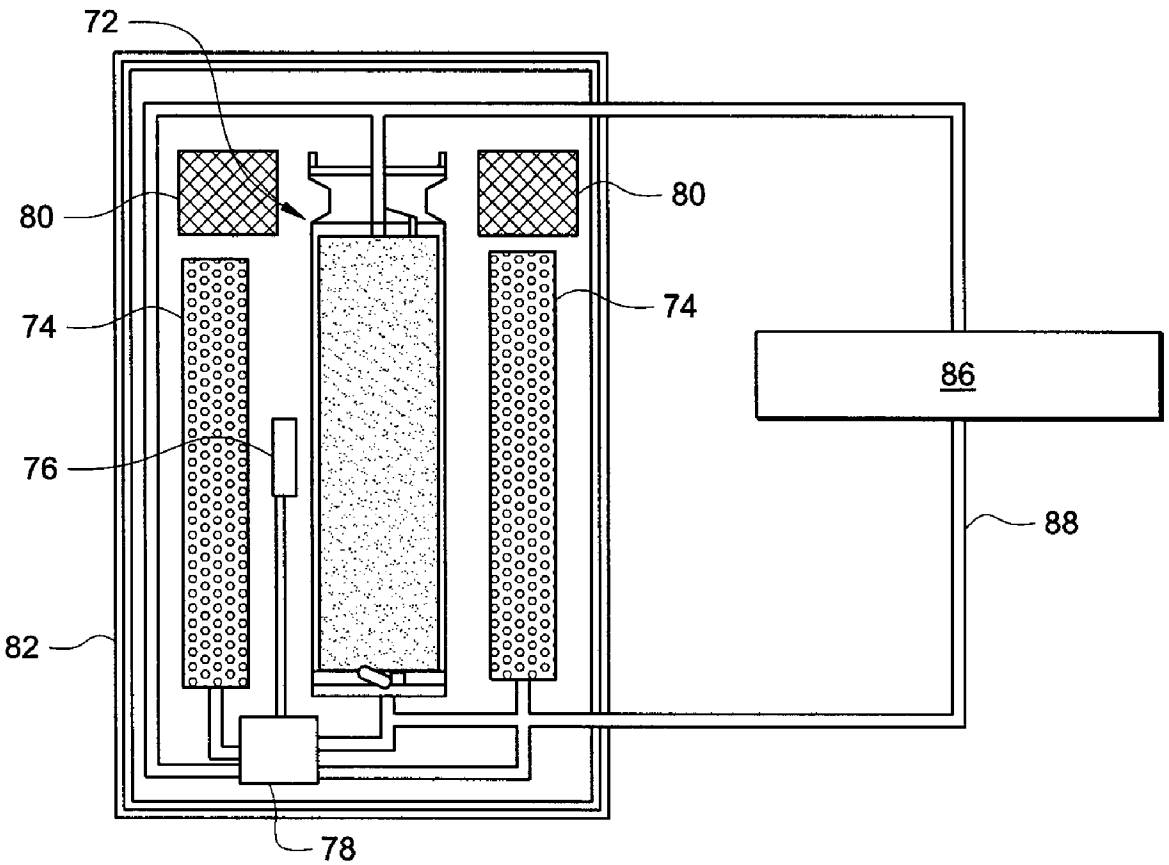
FIG. 7 depicts a side plan view of an embodiment in which a battery/capacitor is heated by external heaters and by the partial discharge of the battery/capacitor.

As shown in FIG. 7, a battery or capacitor (battery/capacitor) 72 may be heated downhole by both an external heat source such as heaters 74 and the discharge of the battery/capacitor 72 itself. The heaters 74 may be, for example, ohmic resistive heaters. A temperature sensor 76 may be positioned near battery/capacitor 72 for detecting its temperature, and a temperature controller 78 may be coupled to the heaters 74 and used to regulate the temperature of battery/capacitor 72. In an embodiment, temperature controller 78 is a pulse-width modulation controller, which changes the width of its pulses to adjust the duty cycle of the applied voltage. This controller usually achieves a more efficient use of power and a closer control of the amount of power supplied to heaters 74 than other controllers. In another embodiment, temperature controller 78 is a proportional gain controller, which registers the need for more heating and then proportionally increases the voltage or current being supplied to heaters 74. In alternative embodiments, other forms of feedback control, feedforward control, adaptive feedforward control, analog control, digital control, or combinations thereof may be implemented to control the heating of a downhole energy storage device.

Further, heat transfer mediums, for example in sealed containers 80, may also be positioned near battery/capacitor 72 for providing it with heat and thereby regulating its thermal losses. As used herein, "heat transfer medium" refers to a material that releases heat when its temperature changes through a phase transformation temperature, which is typically its melting point temperature. Examples of heat transfer mediums include a single constituent material such as tin, an eutectic alloy, i.e., an alloy of two metals that are soluble in the liquid state and insoluble in the solid state, such as cadmium-bismuth alloy, and combinations thereof. Each heat transfer medium in sealed containers 80 may be cooled to below its melting point temperature to cause it to release heat during the phase change from a liquid to a solid. In an embodiment, each heat transfer medium has a melting point temperature greater than ambient downhole temperatures such that it may be sufficiently cooled to change phases by lowering it and battery/capacitor 72 downhole. Before passing it downhole, the heat transfer mediums may be heated at the surface of the earth such that they are initially liquids. The heat released by the heat transfer mediums as they pass downhole may render battery/capacitor 72 operable until it reaches a depth where the ambient downhole temperature is sufficient to provide for continued operation of battery/capacitor 72. It is understood that a heat transfer medium may also be used to heat other energy storage devices such as fuel cells. A thermal insulator 82 may also at least partially surround battery/capacitor 72, heaters 74, and eutectic materials in sealed containers 80. An optional thermal conductor may also be in contact with and used to enhance heat transfer between the energy storage device and heat sources (e.g., a heat transfer medium, resistive heaters 74, or both). Electrical energy produced by battery/capacitor 72 passes through an electrical circuit 88 to an electrical load 86 such as a downhole tool (not shown) and may power heaters 74. Alternate structural heat exchange configurations may be used to heat battery/capacitor 72 by heat generated from external heaters (e.g., heaters 74, heat transfer mediums 80), by heat from the discharge of the battery/capacitor 72, or both. Alternatively, the same heat transfer medium or an additional heat transfer medium may be used to provide cooling for battery/capacitor 72 in case the operating temperature proximate to battery/capacitor 72 is too hot. The heat transfer medium may absorb the extra heat and prevent the battery/capacitor 72 from overheating, allowing the energy storage device to be used in hotter ambient environments and alleviating the problems that could occur if the heat controller encounters oscillations.

Figure 8:
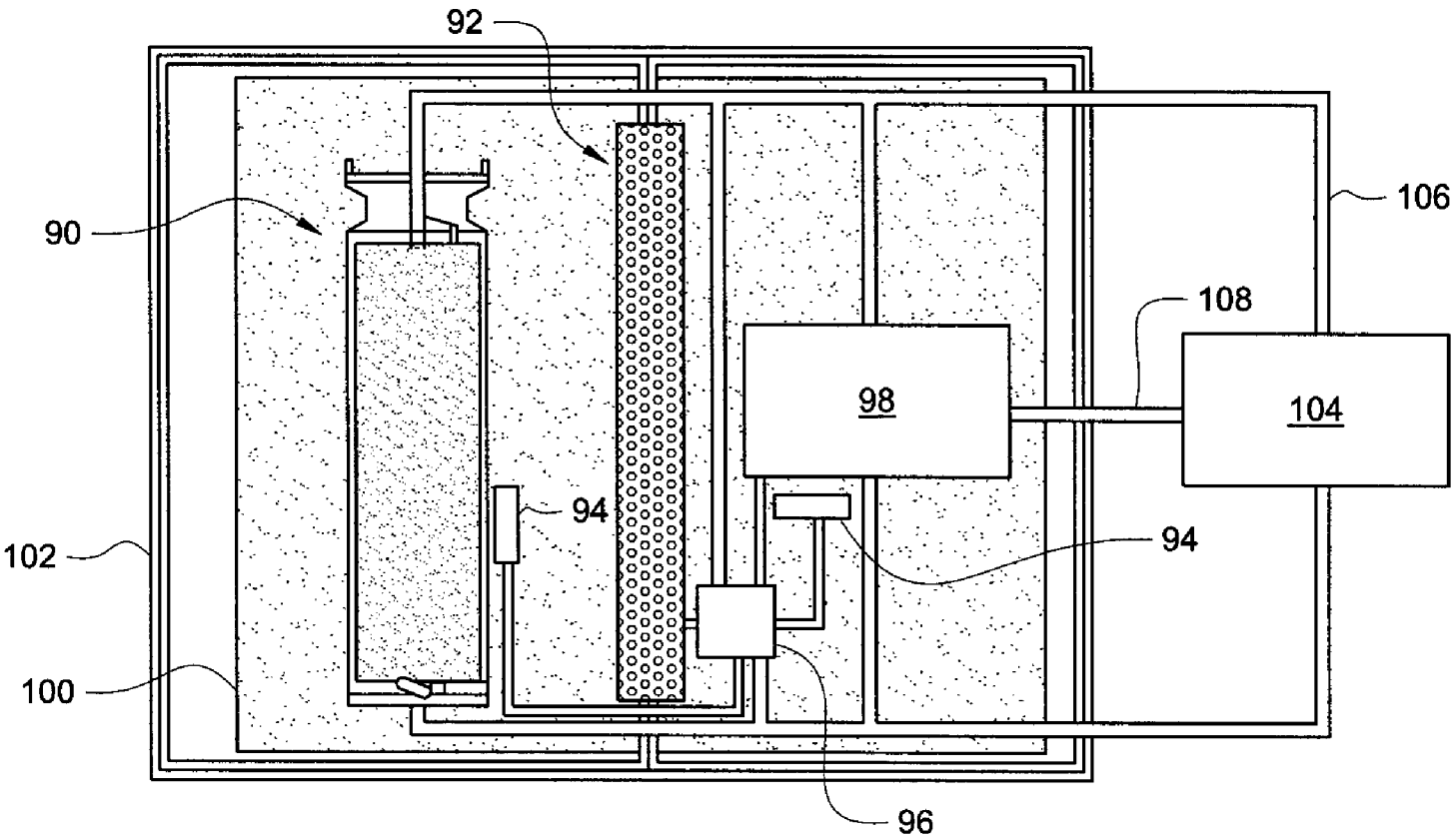
FIGS. 8 and 9 depict side plan views of an alternative embodiments in which a battery/capacitor is heated and/or cooled by a heat pump.

FIG. 8 illustrates an embodiment in which a heat pump 92, i.e., a device that can transfer heat from its surroundings to the space being heated, is used as a heat source for increasing the temperature of battery/capacitor 90. In one embodiment, heat pump 92 contains flow paths through which a refrigerant is evaporated. The heat pump 92 compresses the evaporated vapor to a higher pressure and temperature and then condenses the hot vapor, thus giving off useful heat. In another embodiment, heat pump 92 is a solid-state device. One type of solid-state heat pump that may be used is a peltier device, also known as a thermoelectric module. A peltier device typically comprises two ceramic plates separated by an array of small Bismuth Telluride cubes (couples). When a DC current is applied across a peltier device, heat moves from one side of the device to the other side, which may be used as a heat source. Alternatively, the solid-state device may include multiple types of thermoelectric materials that may be strategically layered to improve the efficiency or the temperature range of the device.

FIG. 8 depicts two types of electrical loads 98 and 104. Electrical load 104 can handle ambient downhole temperatures whereas electrical load 98 operates better at temperatures below the ambient downhole temperatures. As such, heat pump 92 may transfer the heat being generated by electrical load 98 to battery/capacitor 90, thereby heating battery/capacitor 90 while at the same time cooling electrical load 98. Temperature sensors 94 may be located near battery/capacitor 90 and electrical load 98 for detecting the temperatures thereof. Moreover, a temperature controller 96 like that described in relation to FIG. 7 may also be coupled to the heat pump 92 and used to regulate the heating of battery/capacitor 90. The battery/capacitor 90 may generate electrical energy that passes through an electrical circuit 106 to electrical loads 98 and 104, which may be coupled together via electrical line 108. By way of example, electrical load 98 may be used to power a computer processor, and electrical load 104 may be used to power telemetry for sending data received from the computer processor to the surface. A thermal conductor 100 may extend between heat pump 92 and battery/capacitor 90 as well as between heat pump 92 and electrical load 98. Further, a thermal insulator 102 may at least partially surround battery/capacitor 90, heat pump 92, and electrical load 98. It is understood a heat pump may also be used to increase the temperature of other energy storage devices such as a fuel cell. Further, due to its reversible nature, a heat pump could also be used to cool energy storage devices and/or electronics that operate better at temperatures below the ambient downhole temperatures. Alternate structural heat exchange configurations may be used to heat battery/capacitor 90 by heat generated from heat pump 92.

Figure 9:
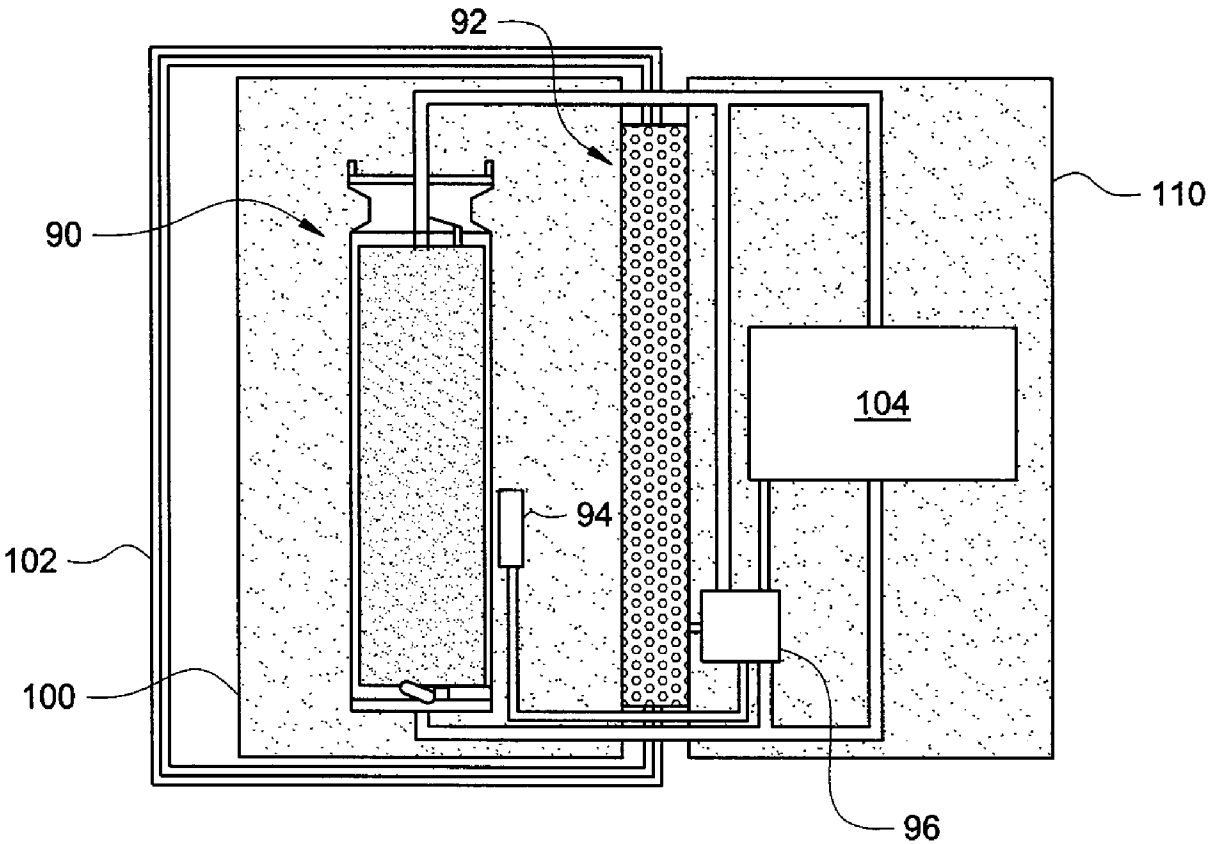

FIG. 9 depicts another embodiment similar to the one shown in FIG. 8 with the exception that heat pump 92 is connected to a heat sink 110 and electrical load 98 and its temperature sensor 94 are not shown. The heat pump 92 may provide heat to battery/capacitor 90 via thermal conductor 100 when the ambient temperature is too cool. Further, the heat pump 92 may be reversed such that it cools battery/capacitor 90 when the ambient temperature is too hot by transferring heat from battery/capacitor 90 to heat sink 110. The heat sink 110, which is positioned outside of thermal insulator 102, absorbs the heat and dissipates it into the air. This use of heat pump 92 to regulate the temperature of battery/capacitor 90 may provide for more consistent performance, expanded efficiency, and operation in a wider range of ambient temperatures. It is understood that heat pump 92 could be replaced with two separate heating and cooling units.

Figure 10:
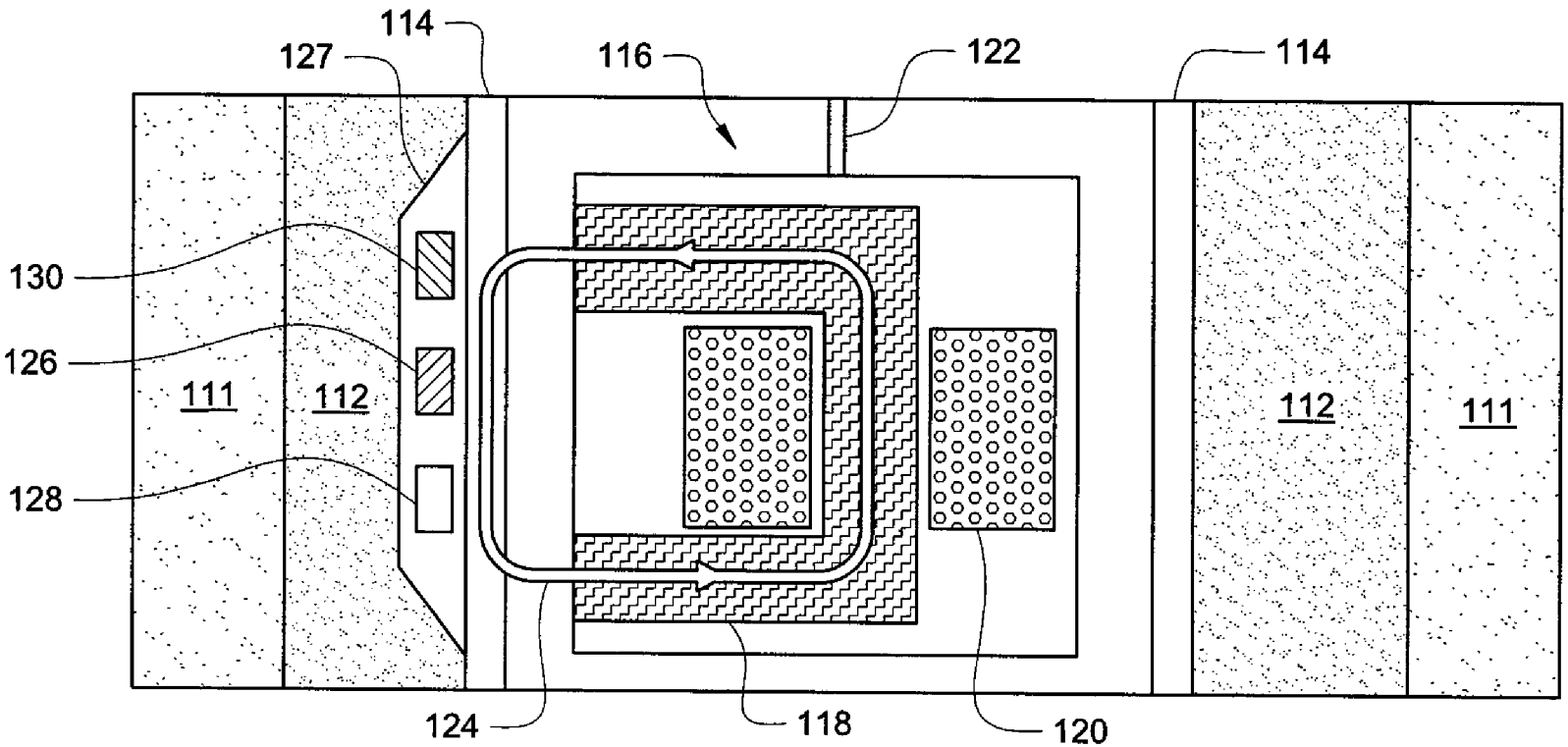
FIG. 10 depicts a side plan view of an embodiment in which a battery disposed on the outside of a casing in a wellbore is heated by a magnetic field created within the casing.

As illustrated in FIG. 10, the heat source for an energy storage device also may be heat energy obtained by the conversion of non-heat energy. In the embodiment shown in FIG. 10, the non-heat energy is a magnetic field. FIG. 10 depicts a subterranean formation 111 that is isolated by a cement column 112 interposed between subterranean formation 111 and a casing (or tubing) 114. A magnetic field generator 116 may be placed within casing 114 that includes a ferromagnetic core 118 and electromagnetic coils 120. A current may be passed down from the surface of the earth via electrical line 122 and through electromagnetic coils 120, thereby generating a magnetic field for heating a battery 126 positioned outside of casing 114. The path of magnetic flux is indicated by line 124. The magnetic field may have a relatively high frequency, e.g., 1 kHz, that causes eddy currents to form. Casing 114 may comprise a conductive material such that the eddy currents cause it to become hot and thereby increase the temperature of battery 126. Alternatively, casing 114 may comprise a non-conductive material, or it may be designed to minimize eddy currents. In this case, a conductive material 127 may be positioned near battery 126 that becomes hot when exposed to the eddy currents. The battery 126 may be used to power an electrical load 128 coupled to a downhole tool. A wireless transmitter 130 may also be located downhole to communicate sensor information or commands with the surface or with another downhole location. Examples of other types of non-heat energy that may be employed to heat a downhole energy storage device include electromagnetic waves, an electric field, high-energy particles, optical waves, acoustic waves, or combinations thereof. The source of the non-heat energy may be lowered into the wellbore on, for example, a wireline, an electric line, tubing, or combinations thereof. Alternatively, the non-heat energy waves or particles may be conveyed from the surface of the earth. A substance having a relatively high loss coefficient relative to the non-heat energy may be positioned to receive the non-heat energy. As such, the energy dissipates on that substance and is converted to heat.

Other heat sources and methods of heating a downhole energy storage device may be employed as deemed appropriate by one skilled in the art. For example, a downhole energy storage device may be coupled in a heat exchange configuration with and heated by waste heat produced by other components used downhole such as power generators, e.g., turbines or vibration-based generators that use vibrations such as ambient vibrations as an energy source. Another heat source is waste heat from a refrigeration system used to cool downhole components such as the electronics of a downhole tool. Examples of suitable refrigeration systems include condenser/expander refrigeration systems or acoustic coolers. The friction of moving parts, e.g., rotating or translating parts, may also serve as a heat source. Moreover, a pressure change could be used as a heat source. For example, gas may be passed through a converging nozzle to increase its pressure, thereby causing its temperature to rise such that the gas may be used for heating. Also, a compressed gas may be released into a vortex tube, resulting in hot gas coming out of one end of the tube and cold gas out of the other end. The vortex tube may include a small valve in the hot end to allow for adjustment of the volume and the temperature of the gas being released. In addition, a radioactive source, i.e., a radioisotope, may be used as a heat source. In particular, the radioisotope generates heat as it decays. Radioisotopes that generate alpha particles or beta particles are preferred because they are more easily shielded than radioisotopes that generate gamma particles and bremsstrahlung. Shields can be placed around the vessel in which the radioisotope is stored downhole.

While preferred embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Use of the term "optionally" with respect to any element of a claim is intended to mean that the subject element is required, or alternatively, is not required. Both alternatives are intended to be within the scope of the claim.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the preferred embodiments of the present invention. The discussion of a reference in the Description of Related Art is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A method of preparing an energy storage device for powering a downhole tool, comprising: heating an energy storage device to an effective temperature to improve operability of the energy storage device, wherein the energy storage device is heated using a heat source, wherein the heat source comprises a heater, and further comprising controlling the effective temperature with a feedforward controller, adaptive feedforward controller, analog controller, digital controller, or combinations thereof.

2. The method of claim 1, wherein the energy storage device comprises a primary battery, a secondary battery, a fuel cell, a capacitor, a heat engine, or combinations thereof.

3. The method of claim 1, wherein the effective temperature is greater than an ambient temperature in the wellbore near the energy storage device.

4. The method of claim 1, wherein the energy storage device is heated using a heat source.

5. The method of claim 4, wherein the heat source comprises a heater.

6. The method of claim 4, wherein the heat source is positioned proximate the energy storage device.

7. The method of claim 4, wherein a thermal conductor extends between the heat source and the energy storage device.

8. The method of claim 4, wherein the heat source and the energy storage device are at least partially surrounded by a thermal insulator.

9. The method of claim 4, wherein the thermal insulator comprises a ceramic solid, ceramic fibers, a glass solid, glass fibers, a polymer solid, polymer fibers, a mineral solid, mineral fibers, a foamed polymer or epoxy, a metalized film, a Dewar flask, a silica aerogel, an air gap, combinations thereof, or nanostructured combinations thereof.

10. The method of claim 4, wherein the energy storage device is at least partially surrounded by an electrical insulator.

11. The method of claim 10, wherein the electrical insulator comprises a ceramic solid, ceramic fibers, a glass solid, glass fibers, a polymer solid, polymer fibers, a mineral solid, mineral fibers, a foamed polymer or epoxy, a Dewar flask, a silica aerogel, a dielectric powder, combinations thereof, or nanostructured combinations thereof.

12. The method of claim 4, wherein the heat source and the energy storage device are at least partially surrounded by an electrical insulator.

13. The method of claim 4, wherein the heat source comprises a non-electrically powered heater, a heat pump, a radioactive source, an exothermic reaction, a power generator, a downhole tool, a refrigeration system for cooling a downhole component, a vortex tube, a converging nozzle for increasing a pressure of a gas, a heat transfer medium, the energy storage device itself, or combinations thereof.

14. The method of claim 1, wherein the energy storage device is heated by changing a temperature of a heat transfer medium positioned proximate the energy storage device, thereby causing the heat transfer medium to undergo a phase transformation such that it releases or absorbs heat.

15. The method of claim 14, wherein the heat transfer medium is cooled by lowering it downhole.

16. The method of claim 1, wherein the energy storage device is heated using heat generated by the discharge of the energy storage device.

17. The method of claim 16, wherein a heat transfer medium is used to regulate thermal loss from the energy storage device.

18. The method of claim 1, wherein the energy storage device is heated by an external heat source.

19. The method of claim 1, wherein the energy storage device comprises a plurality of battery cells operably connected in an electrical series configuration or in an electrical parallel configuration.

20. The method of claim 1, wherein the energy storage device is heated by converting non-heat energy to heat energy.

21. The method of claim 20, wherein a device for generating the energy is lowered into the wellbore on a wireline, an electric line, or a conduit.

22. The method of claim 20, wherein the energy is conveyed from a surface of the earth.

23. The method of claim 1, further comprising cooling the energy storage device.

24. The method of claim 23, wherein a heat pump is used to perform both said heating and said cooling such that a temperature of the energy storage device is regulated to improve its operability.

25. The method of claim 1, wherein the energy storage device is located in an oilfield conduit.

26. The method of claim 1, wherein the energy storage device is located downhole.

27. A method of preparing an energy storage device for powering a downhole tool, comprising: heating an energy storage device to an effective temperature to improve operability of the energy storage device, wherein the energy storage device is heated using a heat source, wherein the heat source comprises a heater, and further comprising controlling the effective temperature with a feedback controller.

28. A method of preparing an energy storage device for powering a downhole tool, comprising: heating an energy storage device to an effective temperature to improve operability of the energy storage device, wherein the energy storage device is heated using a heat source, wherein the heat source comprises a heater, and further comprising controlling the effective temperature with a pulse-width modulation controller.

29. A method of preparing an energy storage device for powering a downhole tool, comprising: heating an energy storage device to an effective temperature to improve operability of the energy storage device, wherein the energy storage device comprises a fuel cell, wherein the fuel cell is heated by pre-heating a reactant being supplied to the fuel cell, wherein the reactant is pre-heated by heat generated by the fuel cell as the reactant passes through a feed line to the fuel cell, and wherein the feed line or the fuel cell is at least partially surrounded by a thermal insulator.

30. The method of claim 29, wherein the reactant is pre-heated by heat exchange with the fuel cell.

31. The method of claim 29, wherein the reactant is pre-heated by heat generated by a downhole tool powered by the fuel cell.

32. A method of preparing an energy storage device for powering a downhole tool, comprising: heating an energy storage device to an effective temperature to improve operability of the energy storage device, wherein the energy storage device comprises a fuel cell, wherein the fuel cell is heated by pre-heating a reactant being supplied to the fuel cell, wherein the reactant is pre-heated by heat generated by the fuel cell as the reactant passes through a feed line to the fuel cell, and wherein the feed line is positioned proximate an exhaust line exiting the fuel cell such that waste heat from the exhaust line heats the feed line.

33. The method of claim 32, wherein the exhaust exiting the fuel cell is contacted with a sorbent material to absorb the exhaust and thereby generate additional heat for heating the feed line.

34. A method of preparing an energy storage device for powering a downhole tool, comprising: heating an energy storage device to an effective temperature to improve operability of the energy storage device, wherein the energy storage device comprises a fuel cell, wherein the fuel cell is heated by pre-heating a reactant being supplied to the fuel cell, wherein the reactant is pre-heated by heat generated by the fuel cell as the reactant passes through a feed line to the fuel cell, and wherein a thermal conductor extends between the fuel cell and the feed line.

35. A method of preparing an energy storage device for powering a downhole tool, comprising: heating an energy storage device to an effective temperature to improve operability of the energy storage device, wherein the energy storage device comprises a fuel cell, wherein the fuel cell is heated by pre-heating a reactant being supplied to the fuel cell, and wherein the reactant is pre-heated by a heater powered by the fuel cell.

36. The method of claim 35, wherein a thermal conductor extends between the heater and a feed line through which the reactant passes to the fuel cell.

37. The method of claim 36, wherein the feed line, the heater, and the thermal conductor are at least partially surrounded by a thermal insulator.

38. A method of preparing an energy storage device for powering a downhole tool, comprising: heating an energy storage device to an effective temperature to improve operability of the energy storage device, wherein the energy storage device comprises a fuel cell, wherein the fuel cell is heated by pre-heating a reactant being supplied to the fuel cell, wherein the reactant is fire-heated by heat generated by a downhole tool powered by the fuel cell, and wherein a thermal conductor extends between electronics of the downhole tool and a feed line through which the reactant passes to the fuel cell.

39. A method of preparing an energy storage device for powering a downhole tool, comprising: heating an energy storage device to an effective temperature to improve operability of the energy storage device, wherein the energy storage device is heated by converting non-heat energy to heat energy and wherein the energy comprises electromagnetic waves, a magnetic field, optical waves, acoustic waves, or combinations thereof.

40. A method of preparing an energy storage device for powering a downhole tool, comprising: heating an energy storage device to an effective temperature to improve operability of the energy storage device, wherein the energy storage device is positioned outside of a conduit disposed in the wellbore, and wherein a magnetic field is generated inside the casing to heat the energy storage device.

41. The method of claim 40, wherein the casing is conductive.

42. The method of claim 40, wherein a conductive material contacts the energy storage device.

43. A system for preparing an energy storage device for powering a downhole tool, comprising: the energy storage device and a heat source for heating the energy storage device, wherein the heat used to heat the energy storage device is a product of a non-electrically powered process or a byproduct of an electrically powered process; and further comprising an electrical insulator at least partially surrounding the energy storage device, wherein the electrical insulator also at least partially surrounds the heat source.

44. The system of claim 43, wherein the heat source is positioned proximate the energy storage device.

45. The system of claim 43, further comprising a thermal conductor extending between the heat source and the energy storage device.

46. The system of claim 43, further comprising a thermal insulator at least partially surrounding the heat source and the energy storage device.

47. The system of claim 43, wherein the heat source comprises a heater.

48. The system of claim 43, wherein the heat source comprises a non-electrically powered heater, a heat pump, a radioactive source, an exothermic reaction, a power generator, a downhole tool, a refrigeration system for cooling a downhole component, a vortex tube, a converging nozzle for increasing a pressure of a gas, a heat transfer medium, the energy storage device itself, heat energy formed from non-heat energy, or combinations thereof.

49. The system of claim 43, further comprising an electrical load operably connected to the energy storage device and the downhole tool.

50. The system of claim 43, wherein the energy storage device comprises a primary battery, a secondary battery, a fuel cell, a capacitor, a heat engine, or combinations thereof.

* * * * *